United States Patent [19]

Asada et al.

[11] Patent Number: 4,780,743

[45] Date of Patent: Oct. 25, 1988

[54] DEVELOPING DEVICE FOR IMAGE FORMING APPARATUS

[75] Inventors: Tomoyuki Asada; Kiyoshi Tomimori, both of Yokohama, Japan

[73] Assignee: Kabushiki Kaisha Toshiba, Kawasaki, Japan

[21] Appl. No.: 31,415

[22] Filed: Mar. 30, 1987

[30] Foreign Application Priority Data

Apr. 7, 1986 [JP] Japan ..... 61-78247

[51] Int. Cl.[4] ..... G03G 15/08

[52] U.S. Cl. ..... 355/3 DD; 355/14 D

[58] Field of Search ..... 355/3 DD, 14 D, 3 R, 355/14 R

[56] References Cited

U.S. PATENT DOCUMENTS

| | | | |
|---|---|---|---|
| 4,385,829 | 5/1983 | Nakahata et al. | 355/3 DD |
| 4,425,382 | 1/1984 | Tajima | 355/3 DD X |
| 4,459,009 | 7/1984 | Hays et al. | 355/3 DD |
| 4,505,573 | 3/1985 | Brewington et al. | 355/3 DD |
| 4,521,098 | 6/1985 | Hosoya et al. | 355/14 D X |
| 4,564,285 | 1/1986 | Yasuda et al. | 355/3 DD |

OTHER PUBLICATIONS

IEEE/IAS, Conf. Record, 1985, p. 1485 (Hosoya et al.).

*Primary Examiner*—A. C. Prescott

*Attorney, Agent, or Firm*—Foley & Lardner, Schwartz, Jeffery, Schwaab, Mack, Blumenthal & Evans

[57] ABSTRACT

A device for transferring charged developing particles onto an electrostatic latent image, comprising a reservoir for holding a quantity of developing particles, a multilayered developing roller rotatably exposed to the quantity of developing particles, including a surface layer for frictionally charging the developing particles with a specified polarity and for attracting the charged developing particles for forming a coating of charged developing particles on the surface layer, and an image carrier for supporting the electrostatic latent image in proximity to the developing roller, the latent image having a polarity opposite to the specified polarity for attracting the charged developing particles from the coating onto the latent image.

19 Claims, 1 Drawing Sheet

DEVELOPING DEVICE FOR IMAGE FORMING APPARATUS

BACKGROUND OF THE INVENTION

1. Field of the Invention

The present invention relates to a developing device which carries out developing by a positively charged single-component developing agent transferring to an image carrier in an image forming apparatus.

2. Description of the Related Art

In an image forming apparatus, such as an electronic copying machine, a developing device is known for developing an electrostatic latent image formed on a photosensitive body, using a single-component developing agent, as disclosed in IEEE/IAS, Conf. Record, 1985, P. 1485 (Hosoya et al.).

This device carries out developing in the following manner. A developing roller, which is a nickel plated aluminum roller, is rotated. A single-component toner, such as a single-component developing agent, is attracted to the surface of the developing roller by triboelectric charges between a stainless steel coating blade and single-component toner particles, and between the developing roller and the single-component toner particles. Then, the single-component toner particles on the surface of the developing roller are caused to adhere electrostatically to a photosensitive body at a developing station facing the photosensitive body. In such a device, when the photosensitive body includes an organic photoconductor (hereafter OPC), the OPC generally has a composition in which an electric charge generating diazo-type dye layer of about 1 μm in thickness and a hydrazone dispersion-type electric charge transport layer of about 20 μm in thickness are multilayered on a substrate. Therefore, this OPC is negatively charged, and for this reason the single-component developing agent used in this kind of photosensitive body must be positively charged.

However, a single-component toner is normally composed of carbon, silica or resin. Such a toner is difficult to charge positively by friction with metal, and most often the toner becomes negatively charged. For this reason, an agitating agent is often used to assist in the positive charging of a single-component toner, although it does not contribute to transport. The agitating agent functions in a manner similar to the carrier particles in a two-component developing agent. The agitating agent is made of iron particles coated with polytetrafluoroethylene. However, even with this kind of method, a sufficient triboelectric charge cannot be obtained, because there is less chance of friction between the single-component toner and the agitating agent. This leads to poor quality developing with randomness of image density and fogging of the image to randomness of the charge. Furthermore, there is the problem of soiling in the vicinity of the developing device because the single-component toner scatters easily due to insufficient adherence of the single-component toner with the developing roller.

SUMMARY OF THE INVENTION

It is an object of the present invention to provide a developing device for an image forming apparatus which can triboelectrically positively charge a single-component developing agent sufficiently with a developing roller.

According to one aspect of the present invention, there is provided a device for transferring charged developing particles onto an electrostatic latent image, comprising reservoir means for holding a quantity of developing particles, multi-layered developing means movably exposed to the quantity of developing particles, including a surface layer for frictionally charging the developing particles with a specified polarity and for attracting the charged developing particles for forming a coating of charged developing particles on the surface layer, and means for supporting the electrostatic latent image in proximity to the developing means, the latent image having a polarity opposite to the specified polarity for attracting the charged developing particles from the coating onto the latent image.

Preferably, the surface layer includes a charging material chargeable with a negative polarity and a conductive material.

It is also preferred that the charging material includes polytetrafluoroethylene and the conductive material includes carbon.

BRIEF DESCRIPTION OF THE DRAWINGS

These and other objects and advantages of this invention will become more apparent and more readily appreciated from the following detailed description of the presently preferred exemplary embodiments, taken in conjunction with the accompanying drawing of which.

DETAILED DESCRIPTION OF THE PREFERRED EMBODIMENTS

Figure 1:
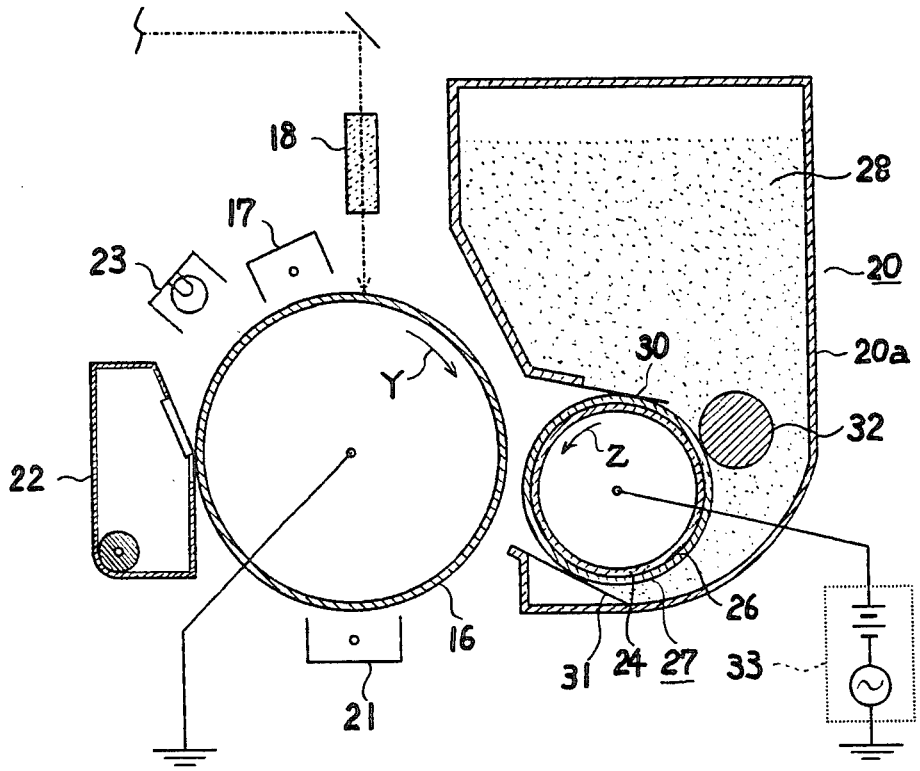
FIG. 1 is a schematic view showing a developing device according to the present invention.

One of the preferred embodiments of the present invention will be described with reference to the accompanying drawing.

In the present invention, the developing device for an image forming apparatus comprises a cylindrical base roller, and a surface layer on the cylindrical base roller for triboelectric charging of a single-component developing agent in positive polarity by friction between the single-component developing agent and the surface layer.

FIG. 1 schematically shows a developing device of the present invention. The following are provided in the main body of an image forming apparatus (not shown), in order around the circumference of a photosensitive drum 16, which is an image carrier made of OPC, and charged in negative polarity. A main charger 17 charges the surface of photosensitive drum 16 to −600 V. An exposure unit 18 radiates an optical image from an original document (not shown). A developing device 20, a transferring charger 21, a cleaning unit 22 and a discharging lamp 23 are provided. In developing device 20, a developing roller 27 is provided and positioned with a gap of 250 μm between it and photosensitive drum 16. The surface of developing roller 27, which serves as a developing agent retaining member, has a surface roughness of about 0.8 μmRz. Developing roller 27 is composed of an aluminum cylindrical roller or base member 24 uniformly surface-treated by sandblasting so that its surface roughness is 0.8 μmRz to 1.5 μmRz. This is covered to a thickness of 15 μm by a surface layer 26 made of a compound of polytetrafluoroethylene, which is easily negatively triboelectrically charged, and carbon in an amount between 1 and 10 wt% of that of the polytetrafluoroethylene. Also, the following are provided in a reservoir 20*a* of developing device 20. A coating blade 30 made of stainless steel is pressed against the surface of developing roller 27 to uniformly form a thin layer of single-component toner 28 on developing roller 27. A sealing blade 31 recovers toner 28 and seals toner 28 after developing to prevent scattering of toner 28 outside the reservoir 20*a*. Agitating roller 32 scrapes off recovered toner 28 from developing roller 27. Moreover, a bias voltage is applied across developing roller 27 and photosensitive drum 16 by a power source 33. The bias voltage includes a direct-current voltage of +200 V and an alternating-current voltage of frequency 2 KHz, peak-to-peak voltage 1.6 KV superimposed on one another.

Next, the operation is described. When copying is commenced, photosensitive drum 16 is rotated in the direction of arrow Y. The surface of photosensitive drum 16 is uniformly negative charged to −600 V by main charger 17. Then, the surface of photosensitive drum 16 is exposed by exposure unit 18 in accordance with an original image, so that an electrostatic latent image of −500 V is formed on photosensitive drum 16, and the drum 16 reaches the developing station. In developing device 20, developing roller 27 is rotated in the direction of arrow Z. As a result, single-component toner 28 is triboelectrically charged with positive polarity and the surface of surface layer 26 is triboelectrically charged with negative polarity by friction between the surface of surface layer 26 and single-component toner 28. Moreover, by friction with coating blade 30, single-component toner 28 is triboelectrically charged. Therefore, single-component toner 28 is electrostatically securely adhered onto the surface of surface layer 26 in a coating and is carried to the developing station. By the action of the bias voltage applied across developing roller 27 and photosensitive drum 16 from power source 33, positively charged toner 28 is transferred to negatively charged electrostatic latent image on photosensitive drum 16 across the gap between roller 27 and drum 16. As a result, a developed image is formed on photosensitive drum 16. After this, photosensitive drum 16 is further rotated in the direction of arrow Y and is made ready for the next copy by the process of transferring the developed image onto a paper sheet, cleaning the drum surface, and discharging the drum surface. Thus, by repeating this kind of copying cycle, the required number of copies can be obtained.

According to the embodiment described above, single-component toner 28 is sufficiently triboelectrically charged in positive polarity by friction with developing roller 27 without using an agitator agent or the like. Even though photosensitve drum 16 is made of OPC, which is charged with a negative polarity, non-uniform developing or image fogging can be reduced, and high quality developing can be carried out consistently. Also, since carbon is contained in surface layer 26, developing roller 27 remains conductive, and the bias voltage can be reliably applied across developing roller 27 and photosensitive drum 16. Also, when triboelectric charging takes place, the excessive charge in negative polarity which successively occurs on the surface of developing roller 27 discharges to aluminum cylindrical roller 24. As a result, the excessive charge does not buildup on surface layer 26.

The present invention is not limited to the above embodiment. There are various possible modifications. For instance, the thickness of the base member of the developing agent retaining member may be varied and although the surface roughness may be in range of 0.2 μmRz to 100 μmRz, a surface roughness of 0.2 μmRz to 10 μmRz is desirable for better charging of the toner. Also, although the material in the surface layer which is easily negatively chargeable may include other resins, polytetrafluoroethylene is preferable, since it has good separability from the toner and is comparatively easily bonded with conductive materials. Moreover, many conductive materials may be used in the surface layer. For instance, nickel or copper may be used. Also, 1 wt% to 15 wt% flaked aluminum with polytetrafluoroethylene may be used.

What is claimed is:

1. A device for transferring charged developing particles onto an electrostatic latent image, comprising:

reservoir means for holding a quantity of developing particles;

multi-layered developing means movably exposed to the quantity of developing particles, including a surface layer for frictionally charging the developing particles with a specified polarity and for attracting the charged developing particles for forming a coating of charged developing particles on the surface layer, the surface layer having a surface roughness of about 0.2 μmRz to about 10 μm Rz; and means for supporting the electrostatic latent image in proximity to the developing means, the latent image having a polarity opposite to the specified polarity for attracting the charged developing particles from the coating onto the latent image.

2. The device of claim 1 wherein the multi-layered developing means includes a base layer having a composition different from that of the surface layer, the surface layer includes a charging material which produces a negative polarity when the surface layer frictionally contacts the developing particles, and the developing particles comprise a single-component developing agent.

3. The device of claim 2 wherein the surface layer also includes a conductive material.

4. The device of claim 2 wherein the charging material includes polytetrafluoroethylene.

5. The device of claim 3 wherein the conductive material includes carbon.

6. The device of claim 2 wherein the base layer includes a cylindrical aluminum roller.

7. The device of claim 6 wherein the cylindrical aluminum roller has the surface layer thereon.

8. The device of claim 1 wherein the supporting means includes an organic material.

9. The device of claim 8 wherein the organic material includes plastic.

10. A device for transferring charged developing particles onto an electrostatic latent image, comprising:

reservoir means for holding a quantity of developing particles;

multi-layered developing means movably exposed to the quantity of developing particles, including a surface layer;

a blade having a fixed end and a free end, the fixed end of the blade being mounted on the reservoir means and the free end of the blade being pressed against the surface layer to make resilient sliding contact with the developing particles on the surface layer for frictionally charging the developing particles with a specified polarity and for attracting the charged developing particles for forming a coating of charged developing particles on the surface layer; and means for supporting the electrostatic latent image in opposed relationship with the developing means with a gap therebetween, the latent image having a polarity opposite to the specified polarity for transferring the charged developing particles from the coating onto the latent image via the gap.

11. The device of claim 10 wherein the multi-layered developing means includes a base layer having a composition different from that of the surface layer, the surface layer includes a charging material which produces a negative polarity when the surface layer frictionally contacts the developing particles, and the developing particles comprise a single-component developing agent.

12. The device of claim 11 wherein the surface layer also includes a conductive material.

13. The device of claim 11 wherein the charging material includes polytetrafluoroethylene.

14. The device of claim 12 wherein the conductive material includes carbon.

15. The device of claim 10 wherein the surface layer has a surface roughness of about 0.2 μmRz to about 10 μmRz.

16. The device of claim 11 wherein the base layer includes a cylindrical aluminum roller.

17. The device of claim 16 wherein the cylindrical aluminum roller has the surface layer theron.

18. The device of claim 10 wherein the supporting means includes an organic material.

19. The device of claim 18 wherein the organic material includes plastic.

* * * * *